US010211580B2

(12) United States Patent
Zhao

(10) Patent No.: US 10,211,580 B2
(45) Date of Patent: Feb. 19, 2019

(54) ELECTRICAL CONNECTOR HAVING WIDENED POWER TERMINALS

(71) Applicant: FOXCONN INTERCONNECT TECHNOLOGY LIMITED, Grand Cayman (KY)

(72) Inventor: Jun Zhao, Huaian (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/808,848

(22) Filed: Nov. 9, 2017

(65) Prior Publication Data

US 2018/0131145 A1 May 10, 2018

(30) Foreign Application Priority Data

Nov. 9, 2016 (CN) ..... 2016 2 1209456 U

(51) Int. Cl.

| | |
|---|---|
| ***H01R 24/60*** | (2011.01) |
| ***H01R 13/04*** | (2006.01) |
| ***H01R 13/6474*** | (2011.01) |
| ***H01R 13/6581*** | (2011.01) |
| *H01R 13/6585* | (2011.01) |
| *H01R 105/00* | (2006.01) |
| *H01R 107/00* | (2006.01) |

(52) U.S. Cl.

CPC ..... *H01R 24/60* (2013.01); *H01R 13/04* (2013.01); *H01R 13/6474* (2013.01); *H01R 13/6581* (2013.01); *H01R 13/6585* (2013.01); *H01R 2105/00* (2013.01); *H01R 2107/00* (2013.01)

(58) Field of Classification Search

CPC ..... H01R 13/6474; H01R 24/60

See application file for complete search history.

(56) References Cited

U.S. PATENT DOCUMENTS

| | | | | |
|---|---|---|---|---|
| 9,231,356 | B1 * | 1/2016 | Ju | H01R 24/78 |
| 9,780,492 | B1 * | 10/2017 | Wang | H01R 13/6471 |
| 2016/0380389 | A1 * | 12/2016 | Ju | H01R 13/6585 439/607.05 |

FOREIGN PATENT DOCUMENTS

| | | |
|---|---|---|
| CN | 203813082 | 9/2014 |
| CN | 105322383 | 2/2016 |

* cited by examiner

*Primary Examiner* — Ross N Gushi

(74) *Attorney, Agent, or Firm* — Wei Te Chung; Ming Chieh Chang

(57) ABSTRACT

An electrical connector includes: an insulative housing; two rows of terminals arranged in the insulative housing, each terminal having a contacting portion, a tail portion, and an intermediate portion between the contacting portion and the tail portion, each row of terminals including two outermost ground terminals, two power terminals, and plural signal terminals, each ground terminal being spaced from a neighboring power terminal by one or more signal terminals, a width of the contacting portion of the ground terminal being greater than a largest width of the signal terminal, a width of the contacting portion of the power terminal being greater than the largest width of the signal terminal; and a shielding shell enclosing the insulative housing; wherein the width of the contacting portion of the power terminal is equal to or greater than 0.4 mm.

11 Claims, 13 Drawing Sheets

ELECTRICAL CONNECTOR HAVING WIDENED POWER TERMINALS

BACKGROUND OF THE INVENTION

1. Field of the Invention

The present invention relates to a dual orientation electrical connector having plural widened power terminals for conducting large current.

2. Description of Related Arts

The traditional USB (Universal Serial Bus) Type C connector is referred to FIG. 13 having the same width of the contacting sections of all the terminals. U.S. Pat. No. 9,711,908 discloses an improvement to the traditional Type C receptacle connector, comprising an insulative housing, two rows of terminals arranged in the insulative housing, and a shielding shell enclosing the insulative housing. Each terminal has a contacting portion, a securing portion, and a tail portion. Each row of terminals include two outermost ground terminals, two power terminals, and plural signal terminals, each ground terminal being spaced from a neighboring power terminals by a pair of signal terminals. A width of the contacting portion of the ground terminal is greater than a width of the signal terminal; a width of the contacting portion of the power terminal is greater than the width of the signal terminal. The width of the contacting portion of the power terminal is about 0.2 mm to 0.3 mm.

SUMMARY OF THE INVENTION

An electrical connector comprises: an insulative housing; two rows of terminals arranged in the insulative housing, each terminal having a contacting portion, a tail portion, and an intermediate portion between the contacting portion and the tail portion, each row of terminals including two outermost ground terminals, two power terminals, and plural signal terminals, each ground terminal being spaced from a neighboring power terminal by one or more signal terminals, a width of the contacting portion of the ground terminal being greater than a largest width of the signal terminal, a width of the contacting portion of the power terminal being greater than the largest width of the signal terminal; and a shielding shell enclosing the insulative housing; wherein the width of the contacting portion of the power terminal is equal to or greater than 0.4 mm.

DETAILED DESCRIPTION OF THE PREFERRED EMBODIMENT

Figure 1:
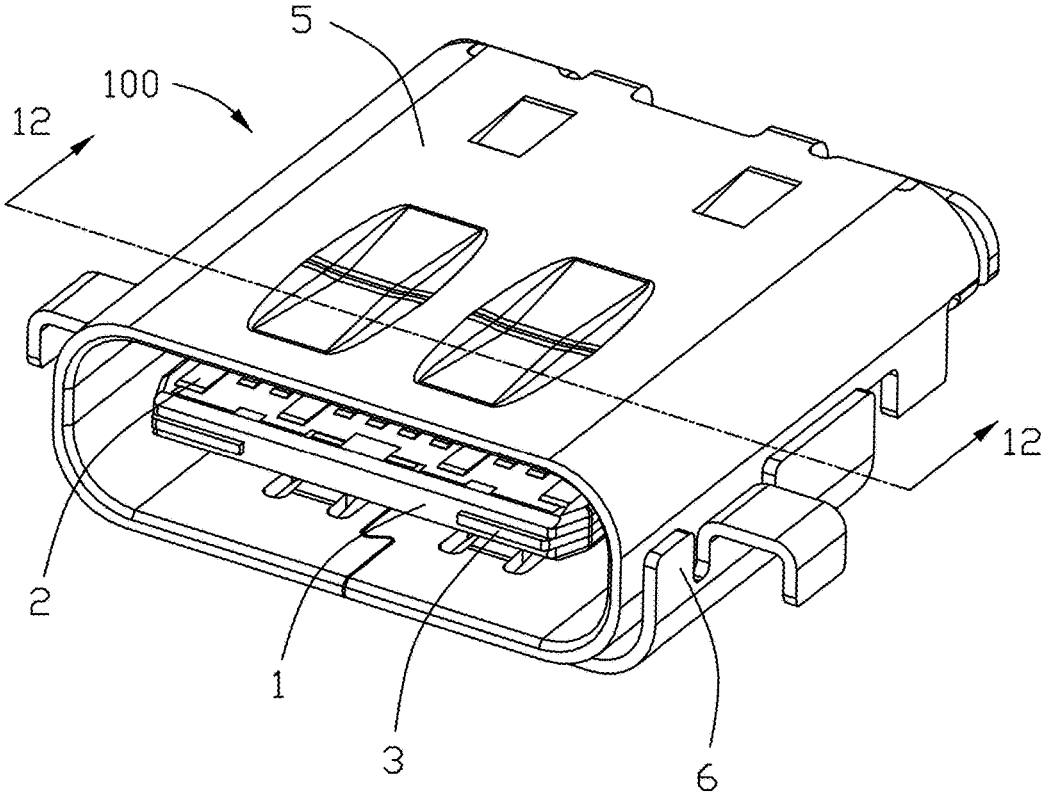
FIG. 1 is a perspective view of an electrical connector in accordance with the present invention.

Referring to FIGS. 1-2 and 5-6, an electrical connector 100 comprises an insulative housing 1, two rows of terminals 2 arranged in the insulative housing 1, and a shielding shell 5 enclosing the insulative housing 1. The electrical connector 100 may further comprise a metallic shielding plate 3 arranged in the insulative housing 1 between the two rows of terminals 2, a metal cover 6 attached to a bottom of the shielding shell 5, and a sealing member 7 at a rear of the insulative housing 1.

Referring to FIGS. 3-11, the two rows of terminals 2 are reversely-symmetrically arranged as an upper row of first terminals 21 and a lower row of second terminals 22. Each terminal 2 has a contacting portion 28, a tail portion 29, and an intermediate portion 27 between the contacting portion and the tail portion. Each row has twelve (12) terminals, including two outermost ground terminals 24, two power terminals 25, and eight (8) signal terminals 26. Each ground terminal 24 is spaced from a neighboring power terminal 25 by two signal terminals 26. A largest width d1 of the power terminal 25 is greater than a largest width d2 of the signal terminal 26; a largest width d1' of the ground terminal 24 is greater than the largest width d2 of the signal terminal 26. In one embodiment, given the width d1 of the power terminal 25 to be 0.4 mm, the width d1' of the ground terminal 24 of being not less than 0.4 mm and a respective distance d3 between the power terminal 25 and each of two adjacent signal terminals 26 of being 0.175 mm may achieve a preferred impedance and conduct large current while ensuring no risk of shorting. While increasing the width d1' of the ground terminal 24 to be no less than 0.4 mm, a distance d3' between the ground terminal 24 and the adjacent signal terminal 26 is kept at no less than 0.175 mm but an outer side 241 of the ground terminal 24 is extended outwardly to have a larger width. In another embodiment where the width d1 of the power terminal 25 is greater than 0.4 mm, keeping the distances d3 and d3' to be no less than 0.15 mm may also meet requirement of conducting large current while ensuring no risk of shorting. Preferably, the contacting portions of the power and ground terminals have same width. Each terminal 21 is of uniform width except for the tail portion; each terminal 22 is of uniform width except for the tail portion and the intermediate portion.

Figure 5:
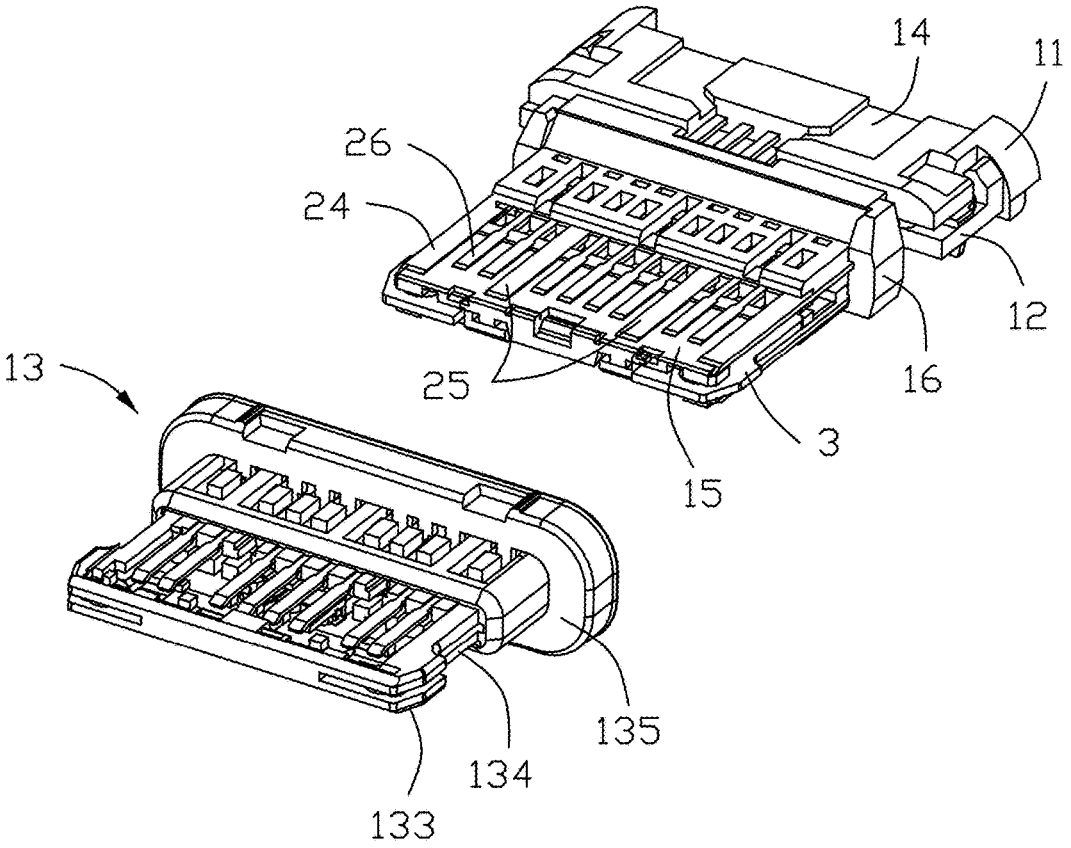
FIG. 5 is a partially exploded view of the assembly in FIG. 3.
Figure 6:
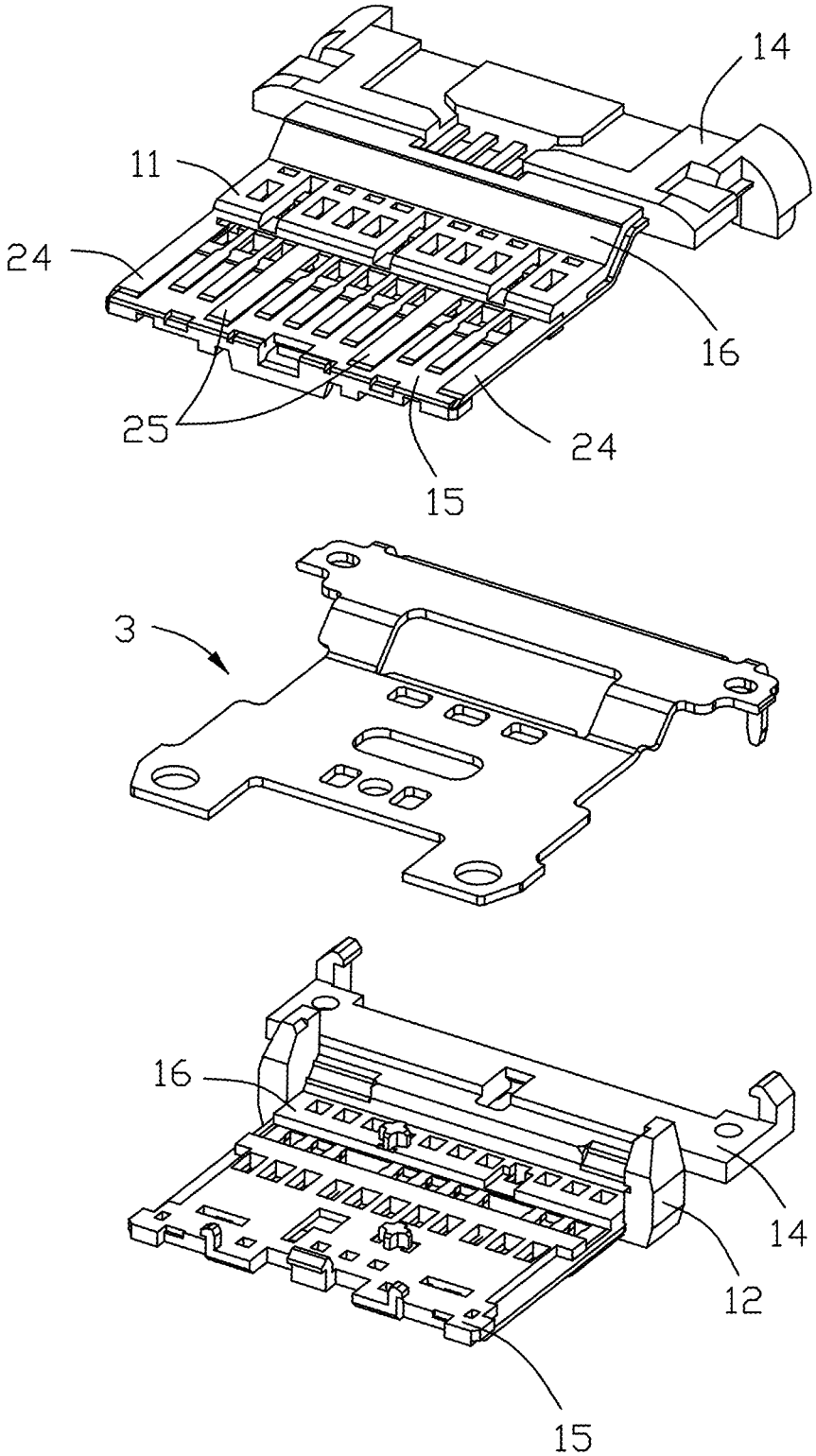
FIG. 6 is a further exploded view of the assembly in FIG. 5.
Figure 7:
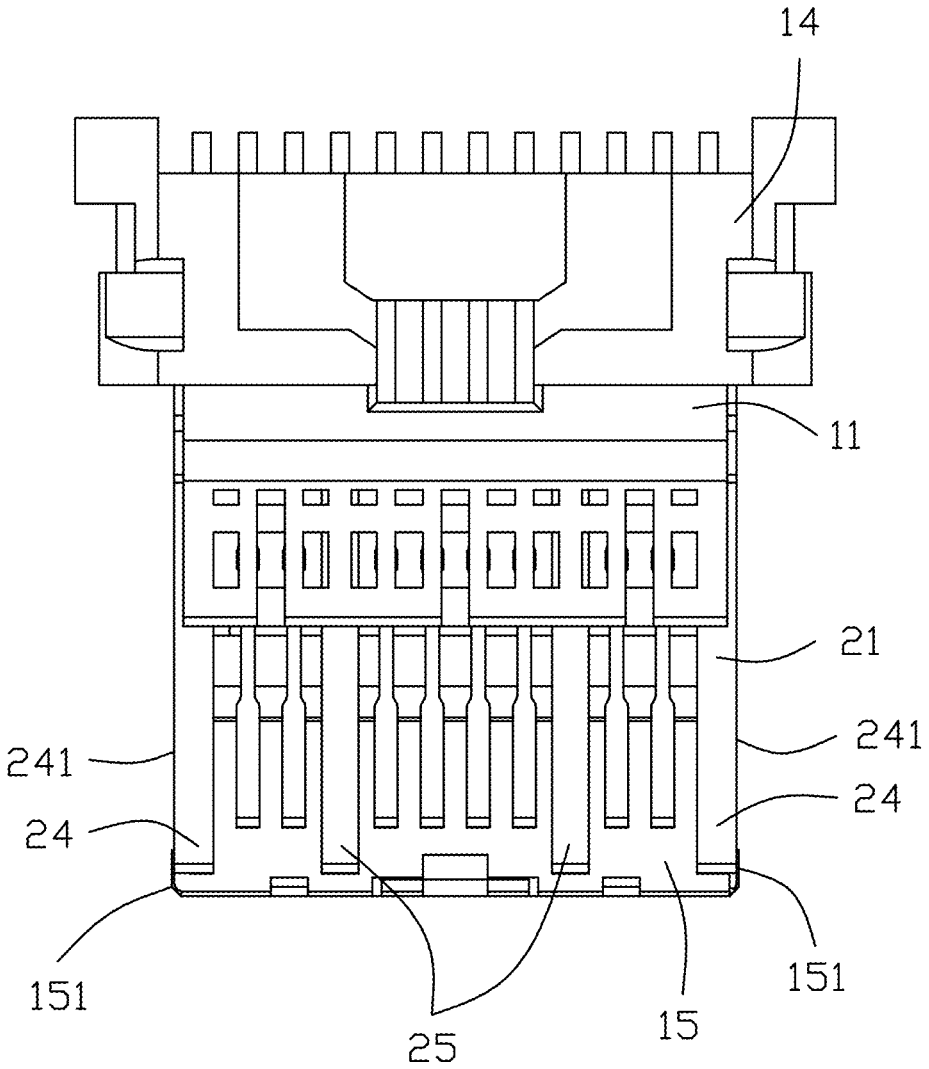
FIG. 7 is a top view of an upper part of the assembly in FIG. 6.
Figure 8:
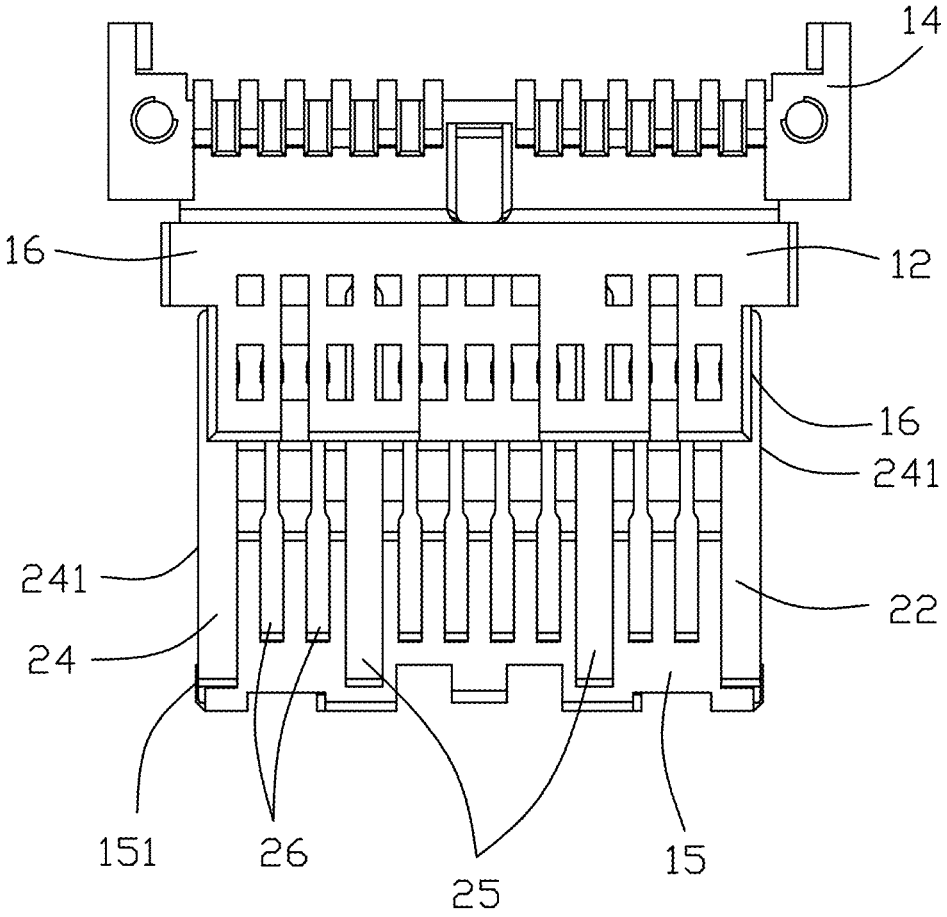
FIG. 8 is a bottom view of a lower component of the assembly in FIG. 6.

Referring also to FIGS. 5-6, the insulative housing 1 includes a first body 11 receiving the first terminals 21, a second body 11 receiving the second terminals 22, and a third body 13 over-molding the first body 11 and the second body 12. Each of the first body 11 and the second body 12 has a base 14, a tongue 15, and a connecting part 16. The contacting portions 24 of the first and second terminals 21 and 22 are exposed to opposite surfaces of the tongue 15.

Figure 9:
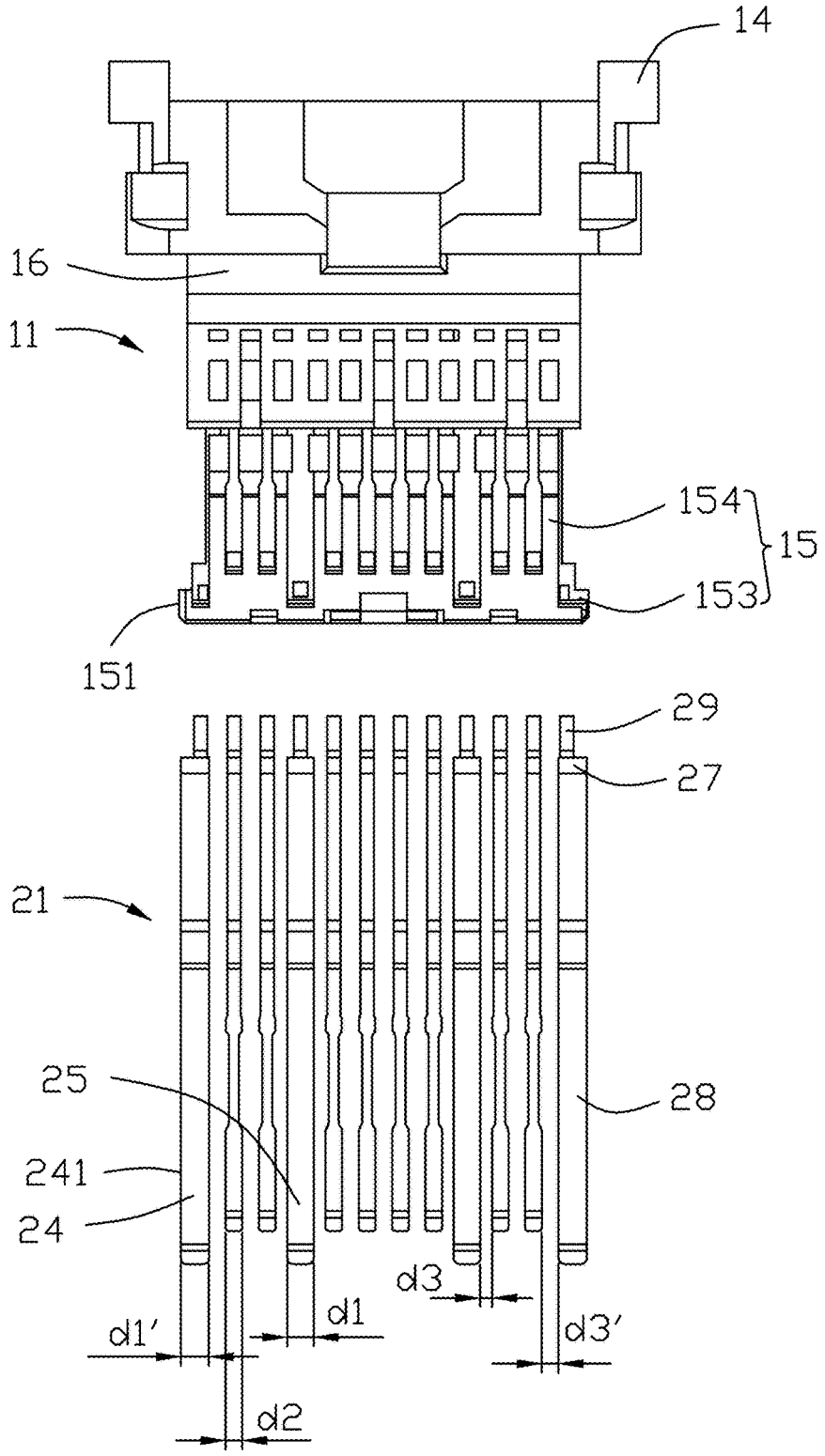
FIG. 9 is a top view showing a further exploded view of the upper component in FIG. 7.
Figure 10:
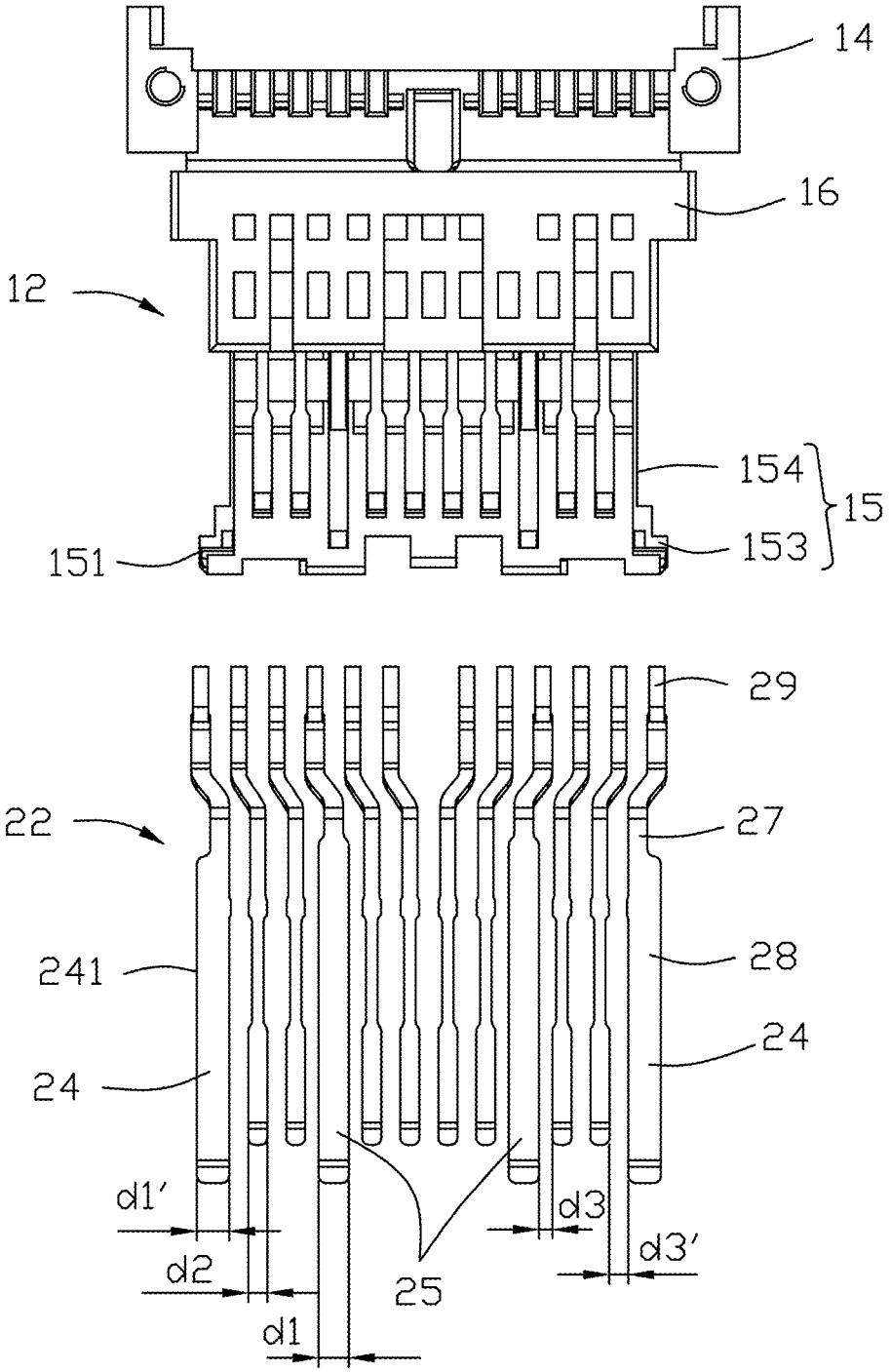
FIG. 10 is a bottom view showing a further exploded view of the lower component in FIG. 8.
Figure 11:
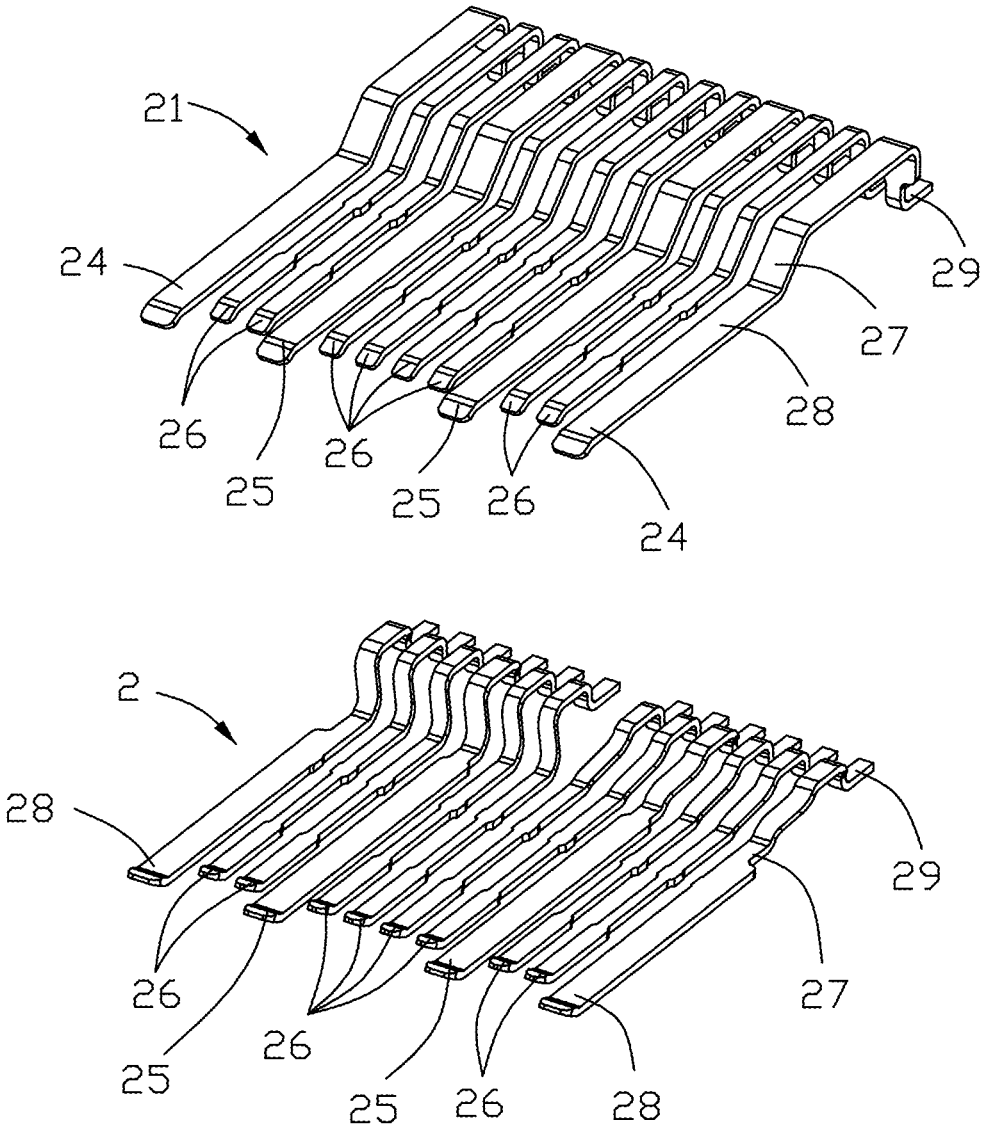
FIG. 11 is an exploded view showing the plurality of terminals.

The tail portions 25 of the first and second terminals 21 and 22 extend outwardly of associated bases 14. The tongues 15 of the first and second bodies 11 and 12 include a middle part 154 and a front part 153 (FIGS. 9 and 10). Two lateral sides of the front part 153 extend beyond the middle part 154 and beyond the outermost sides of the connecting part 16. The outermost side of the front part 153 is the outermost sides of the first body 11 and the second body 12. The outermost side of the ground terminal 24 extends beyond the outermost side of the middle part 154. The third body 13 includes a rear part 135, a front part 133, and a main part 134 connecting the rear part 135 and the front part 133.

Figure 12:
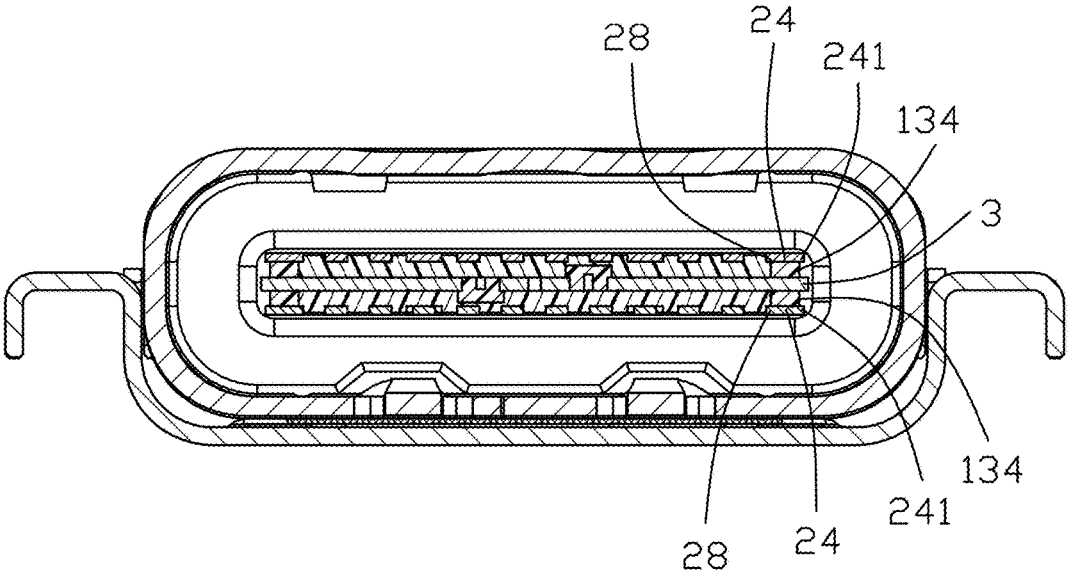
FIG. 12 is a cross-sectional view of the electrical connector of FIG. 1 along line A-A to show the ground terminal extends outwardly and laterally beyond the lateral side edge of the tongue.

The outer side or side edge 241 of the ground terminal 24 extends beyond the outermost side of the connecting part 16. As shown in FIG. 12, in this embodiment the outer sides 241 of the ground terminals 24 essentially slightly laterally/sidewardly protrude beyond outermost sides or side edges of the main part 134 of the third body 13. For easy illustration, the tongue 15 of the first body 11, the tongue portion 15 of the second body 12 and the main part 134 of the third body 13 commonly forms a complete mating tongue (not labeled) of the connector 100 on which the contacting portions 28 of all the terminals 21, 22 are exposed upon two opposite mating surfaces (not labeled) for mating with the corresponding plug connector.

In the electrical connector 100, by designing the widths of the power terminals 25 and the ground terminals 24 to be greater than the largest of the signal terminals 26, the widths of the contacting portions of the power terminals 25 and the ground terminals 24 to be no less than 0.4 mm, and the distance between two adjacent terminals 2 to be no less than 0.15 mm, the requirement of conducting large current while ensuring no risk of shorting may be ensured.

Figure 2:
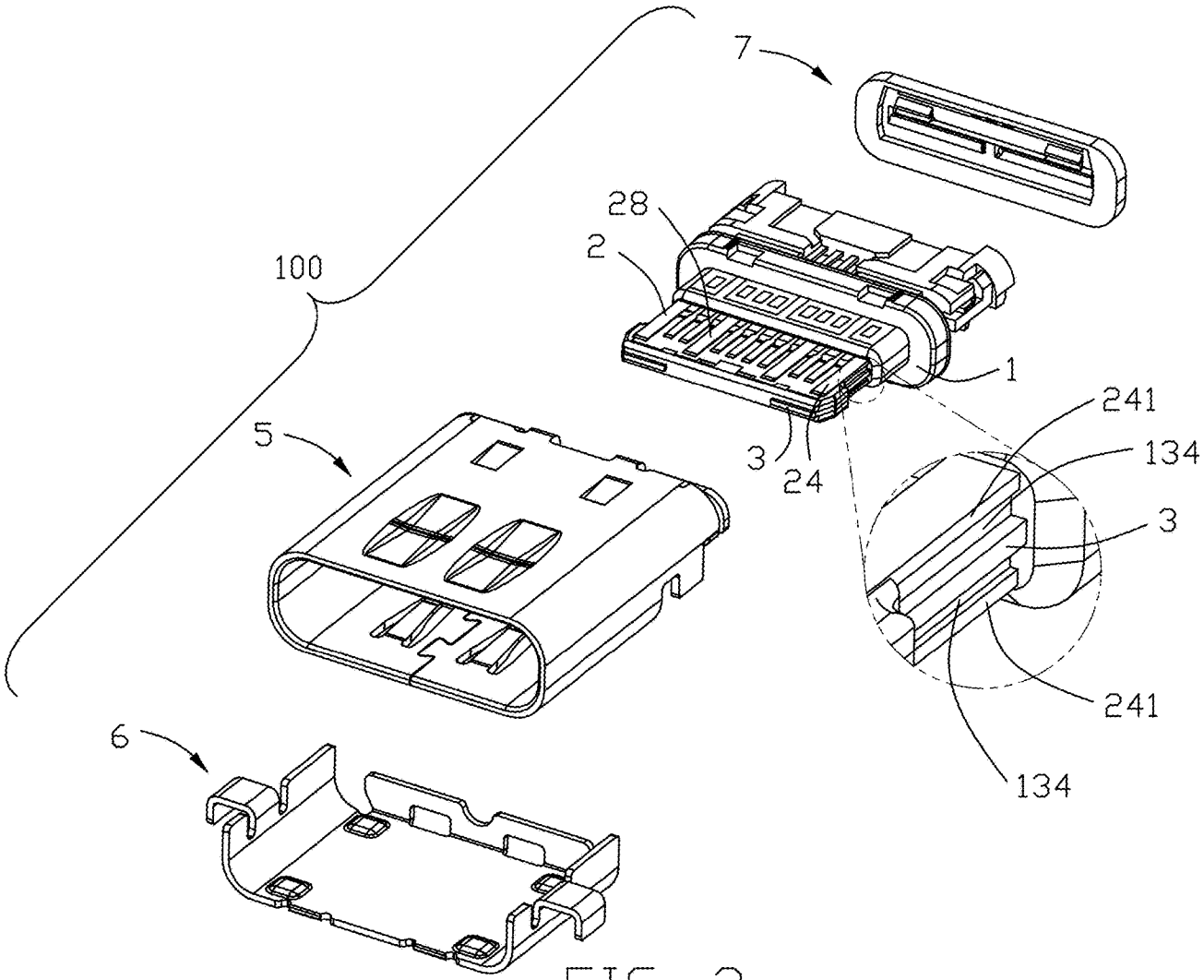
FIG. 2 is a partially exploded view of the electrical connector.
Figure 3:
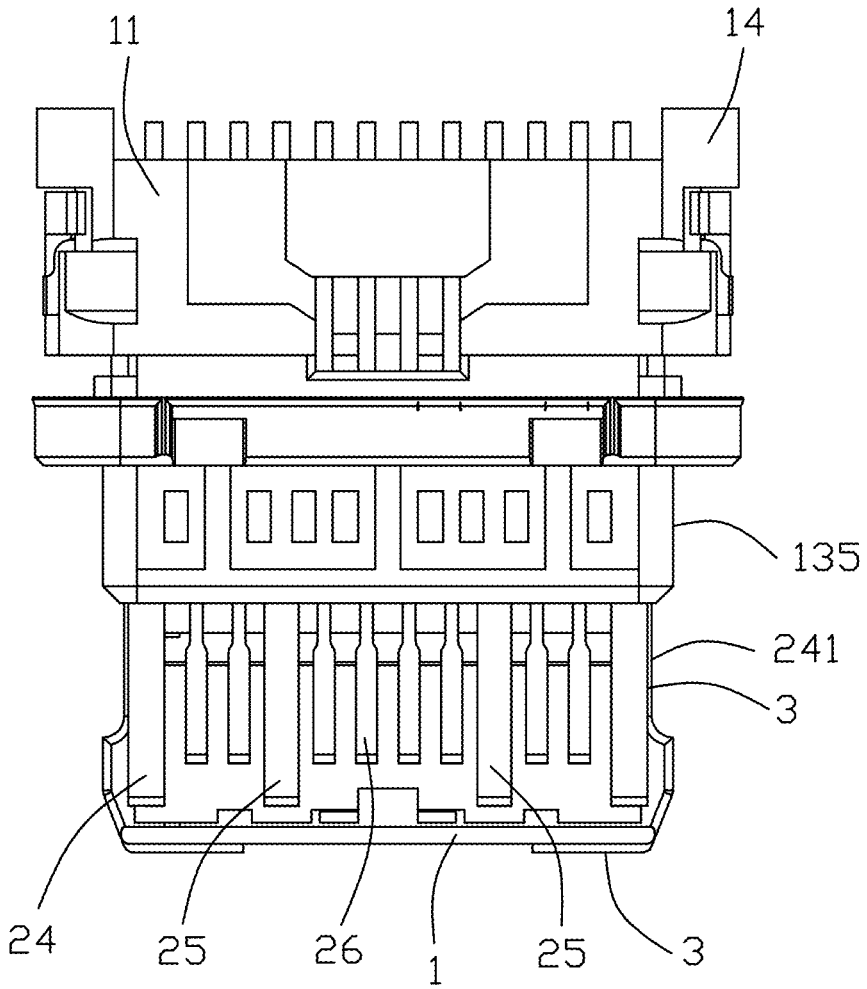
FIG. 3 is a top view of an assembly of an insulative housing, a plurality of terminals, and a metallic plate of the electrical connector.
Figure 4:
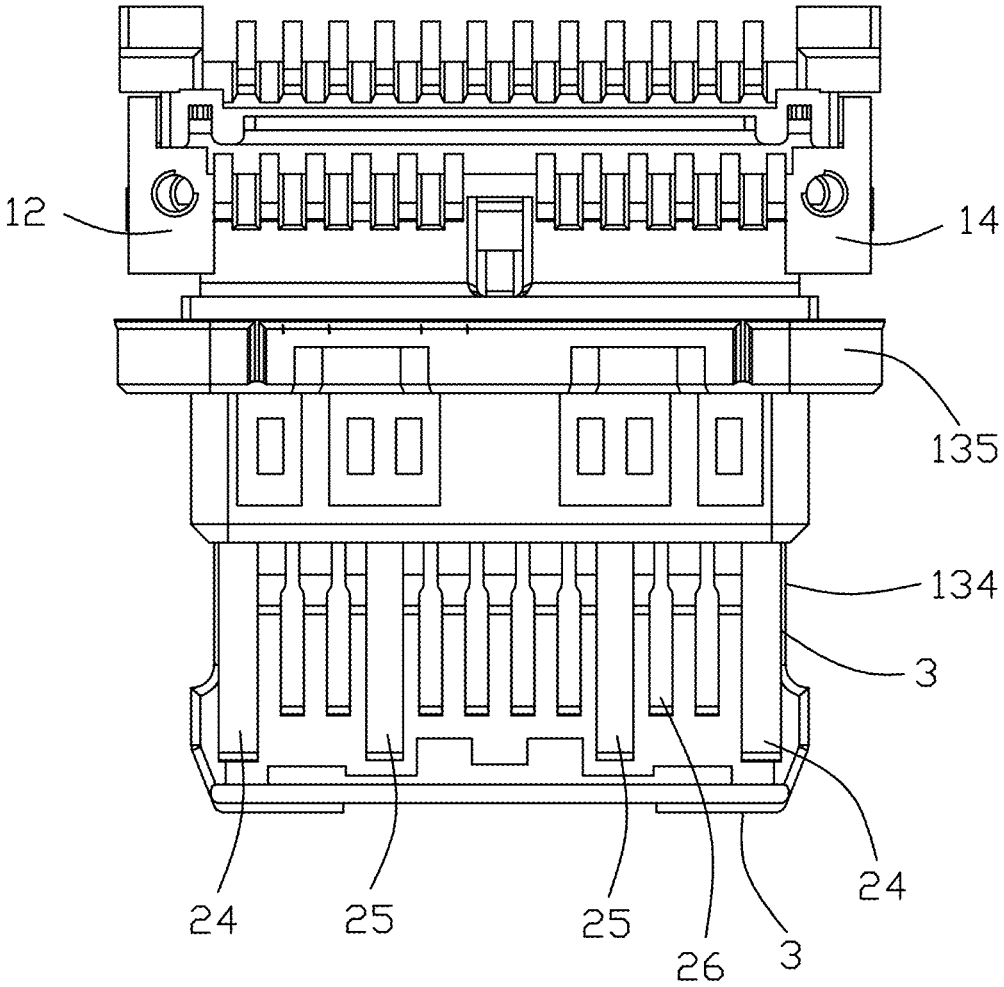
FIG. 4 is a bottom view of the assembly in FIG. 3.
Figure 13:
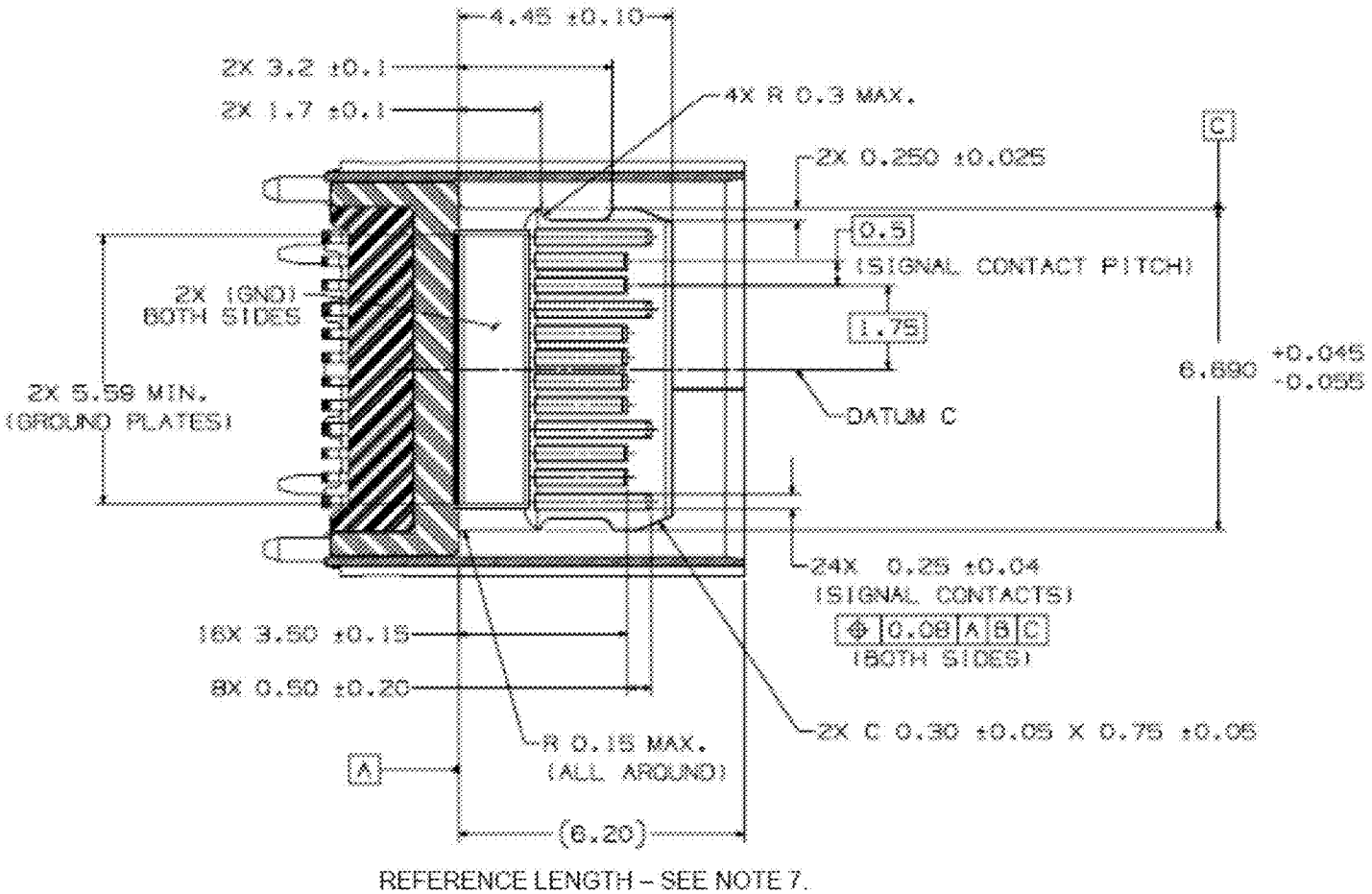
FIG. 13 (PRIOR ART)
FIG. 13 is a diagram derived from USB Type C specification Release 1.3, page 33, to show the relative dimensions among the terminals, the tongue and metallic shielding plate.

In brief, generally speaking as shown in FIG. 13, in the traditional connector all terminals 21, 22 has a 0.25 mm width of the contacting portion 28 on the mating tongue with a 0.5 mm pitch along the transverse direction. Such constant design is essentially not preferable for larger power delivery. The aforementioned U.S. Pat. No. 9,711,908 though discloses the widened contacting portions of the power and ground terminals, the width of the power terminal and the ground terminal is still not wide/large enough for the relatively larger power delivery. In the first embodiment of the invention, a width of 0.4 mm for the contacting portion 28 of the power terminal 25 can efficiently overcome the power shortage issue while at the same time the relatively tiny distance of the 0.175 mm is still kept between the contacting portion 28 of the power terminal 25 and the contact portion 28 of the neighboring signal contact 26 without jeopardizing either the mechanical or the electrical characters of the whole connector 100. Correspondingly, the corresponding ground terminal 24 is also expected to be widened with a 0.4 mm width to comply with the widened power terminal 25. Similarly, the second embodiment uses the enlarged width greater than 0.4 mm of the power/ground terminal to cooperate with the minimum space not less than 0.15 mm between the neighboring terminals for achieving the similar effect. Notably, in the invention, to achieve the widened dimension to be at least 4.0 mm, the outer side edge of the contacting portion 28 of the ground terminal 24 extends laterally/sidewardly outwardly beyond the side edge (not labeled) of the mating tongue, i.e., the side edge of the main part 134, as shown in FIGS. 2 and 12. In another alternate embodiment (not shown), to achieve the similar effect, the side edge 241 of the contact portion 28 of the ground terminal 24 can be essentially flush with the side edge of the mating tongue in the vertical direction without any minor protrusion. Anyhow, the side edge (not labeled) of the shielding plate 3 always sidewardly extends beyond the side edge of the mating tongue and the side edge 241 of the ground terminal 24 in the transverse direction. Generally, the transverse dimension of the mating tongue on the main part 134 as shown in FIG. 12 is around 6.2 mm as regulated by the Type C standard specification.

What is claimed is:

1. An electrical connector comprising:

an insulative housing;

two rows of terminals arranged in the insulative housing, each terminal having a contacting portion, a tail portion, and an intermediate portion between the contacting portion and the tail portion, each row of terminals including two outermost ground terminals, two power terminals, and plural signal terminals, each ground terminal being spaced from a neighboring power terminal by one or more signal terminals, a width of the contacting portion of the ground terminal being greater than a largest width of the signal terminal, a width of the contacting portion of the power terminal being greater than the largest width of the signal terminal; and a shielding shell enclosing the insulative housing; wherein the width of the contacting portion of the power terminal is equal to or greater than 0.4 mm; and a side edge of the ground terminal is either flush with or slightly sidewardly projects beyond a side edge of the mating tongue on which the contacting portions of the terminals are exposed.

2. The electrical connector as claimed in claim 1, wherein the width of the contacting portion of the ground terminal is equal to or greater than 0.4 mm.

3. The electrical connector as claimed in claim 1, wherein a distance between the contacting portion of the power terminal and the contacting portion of an adjacent signal terminal is equal to or greater than 0.15 mm.

4. The electrical connector as claimed in claim 3, wherein said distance is 0.175 mm.

5. The electrical connector as claimed in claim 1, wherein:

each ground terminal is spaced from a neighboring power terminal by a pair of signal terminals; and a distance between the contacting portions of the pair of signal terminals is substantially equal to a distance between the contacting portion of the ground terminal and an adjacent signal terminal of the pair of signal terminals.

6. An electrical connector comprising:

an insulative housing including a mating tongue with two opposite mating surfaces in a vertical direction;

a metallic shielding plate embedded within the mating tongue between the opposite mating surfaces; and two rows of terminals disposed in the housing, each of said terminals having a contacting portion exposed upon the mating surface, said terminals including at least one ground terminal, one power terminal and a pair of signal terminals therebetween in a transverse direction perpendicular to said vertical direction; wherein in said transverse direction, a width of the contacting portion of the power terminal is 0.3~0.4 mm and a width of the contacting portion of the ground terminal is not less than 0.3 mm;

the width of the contacting portion of the power terminals is 0.4 mm and the width of the contacting portion of the ground terminal is not less than 0.4 mm;

in said transverse direction, a distance between the ground terminal and the neighboring signal terminal is 0.15 mm; and a side edge of the contacting portion of the ground terminal is flush with a side edge of the mating tongue in said vertical direction.

7. The electrical connector as claimed in claim 6, wherein in said transverse direction, a distance between the contacting portion of the power terminal and that of the neighboring signal terminal is 0.175 mm.

8. The electrical connector as claimed in claim 6, wherein in said transverse direction, a distance between the ground terminal and the neighboring signal terminal is 0.175 mm.

9. The electrical connector as claimed in claim 6, wherein there are twelve terminals in each row, and a dimension of the mating tongue in said transverse direction is 6.2 mm.

10. An electrical connector comprising:

an insulative housing including a mating tongue with two opposite mating surfaces in a vertical direction;

a metallic shielding plate embedded within the mating tongue between the opposite mating surfaces; and two rows of terminals disposed in the housing, each of said terminals having a contacting portion exposed upon the mating surface, said terminals including at least one ground terminal, one power terminal and pair of signal terminals therebetween in a transverse direction perpendicular to said vertical direction; wherein in said transverse direction, a width of the contacting portion of the power terminal is 0.3-0.4 mm and a width of the contacting portion of the ground terminal is not less than 0.3 mm;

the width of the contacting portion of the power terminals is 0.4 mm and the width of the contacting portion of the ground terminal is not less than 0.4 mm;

in said transverse direction, a distance between the ground terminal and the neighboring signal terminal is 0.175 mm; and a side edge of the contacting portion of the ground terminal slightly sidewardly projects beyond a side edge of the mating tongue.

11. The electrical connector as claimed in claim 10, wherein in said transverse direction, a distance between the contacting portion of the power terminal and that of the neighboring signal terminal is 0.175 mm.

* * * * *